US007488097B2

(12) United States Patent
Reisenauer et al.

(10) Patent No.: US 7,488,097 B2
(45) Date of Patent: Feb. 10, 2009

(54) LED LAMP MODULE

(75) Inventors: William Reisenauer, Commack, NY (US); Wojciech Pawelko, Deer Park, NY (US)

(73) Assignee: CML Innovative Technologies, Inc., Hackensack, NJ (US)

( * ) Notice: Subject to any disclaimer, the term of this patent is extended or adjusted under 35 U.S.C. 154(b) by 72 days.

(21) Appl. No.: 11/474,531

(22) Filed: Jun. 26, 2006

(65) Prior Publication Data

US 2007/0195532 A1 Aug. 23, 2007

Related U.S. Application Data

(60) Provisional application No. 60/775,268, filed on Feb. 21, 2006.

(51) Int. Cl.
*F21V 29/00* (2006.01)

(52) U.S. Cl. ..... 362/373; 362/294; 362/800

(58) Field of Classification Search ..... 362/253, 362/252, 191, 249, 364, 294, 373, 646, 555, 362/800, 434, 227, 240; 257/79, 98, 99, 257/675

See application file for complete search history.

(56) References Cited

U.S. PATENT DOCUMENTS 5,765,940 A * 6/1998 Levy et al. ..... 362/240
5,853,242 A * 12/1998 Bouffay et al. ..... 362/191
5,857,767 A 1/1999 Hochstein
6,045,240 A 4/2000 Hochstein
6,072,522 A * 6/2000 Ippolito et al. ..... 348/14.1
6,161,910 A * 12/2000 Reisenauer et al. ..... 315/309
6,362,964 B1 * 3/2002 Dubhashi et al. ..... 361/707
6,428,189 B1 8/2002 Hochstein
6,462,475 B1 10/2002 Lee
6,517,218 B2 2/2003 Hochstein
6,578,994 B1 6/2003 Beyerlein
6,787,999 B2 9/2004 Stimac et al.
6,791,840 B2 9/2004 Chun
6,799,864 B2 10/2004 Bohler et al.
6,864,513 B2 3/2005 Lin et al.
6,948,829 B2 * 9/2005 Verdes et al. ..... 362/227
6,964,501 B2 11/2005 Ryan
6,982,518 B2 1/2006 Chou et al.
7,168,827 B2 * 1/2007 Stein et al. ..... 362/299
7,296,916 B2 * 11/2007 Ouderkirk et al. ..... 362/373
7,300,173 B2 * 11/2007 Catalano et al. ..... 362/208

(Continued)

*Primary Examiner*—Jong-Suk (James) Lee
*Assistant Examiner*—David R Crowe
(74) *Attorney, Agent, or Firm*—Michael J. Porco; Gerald E. Hespos; Anthony J. Cesella

(57) ABSTRACT

An LED lamp module designed to be easily retrofitted into existing incandescent based light fixtures with minimum modification is provided. The LED lamp module includes a generally circular metal core board including a first surface and a second surface; at least one LED disposed centrally on the first surface of the metal core board; and a flat annular printed circuit board including a current driver circuit for powering the at least one LED, the annular printed circuit board being disposed around the at least one LED and electrically coupled to the at least one LED, wherein the second surface of the metal core board is configured to contact a host fixture and heat generated by the at least one LED is conducted to the host fixture. The LED lamp module uses the host light fixture as a heat sink to transfer and dissipate heat to the external environment.

16 Claims, 5 Drawing Sheets

U.S. PATENT DOCUMENTS

2004/0169451 A1* 9/2004 Oishi et al. ..... 313/45
2004/0184272 A1 9/2004 Wright et al.
2004/0212321 A1* 10/2004 Lys et al. ..... 315/291
2004/0222427 A1* 11/2004 Hsiung ..... 257/79
2004/0264195 A1* 12/2004 Chang et al. ..... 362/294
2005/0073840 A1 4/2005 Chou et al.
2005/0073848 A1* 4/2005 King et al. ..... 362/296
2005/0111234 A1 5/2005 Martin et al.
2006/0013002 A1 1/2006 Coushaine et al.
2006/0061997 A1* 3/2006 Lin ..... 362/294
2007/0241937 A1* 10/2007 Horst et al. ..... 340/984

* cited by examiner

LED LAMP MODULE

PRIORITY

This application claims priority to an application entitled "LED LAMP MODULE" filed in the United States Patent and Trademark Office on Feb. 21, 2006 and assigned Ser. No. 60/775,268, the contents of which are hereby incorporated by reference.

BACKGROUND

1. Field

The present disclosure relates generally to light bulb and lamp assemblies, and more particularly, to a light emitting diode (LED) lamp module configured to replicate the light output of a conventional incandescent light bulb.

2. Description of the Related Art

Incandescent light bulbs are used in a large variety of lighting products. Although inexpensive to purchase, incandescent light bulbs have several drawbacks. First, incandescent light bulbs use a relatively large amount of power compared to other lighting products which increase energy costs. Second, incandescent light bulbs have a short life causing repetitive replacement costs. Furthermore, since theses bulbs have a short life, labor costs will subsequently be effected by having maintenance personnel constantly replace the bulbs.

Recently, a trend in the lighting industry is to develop light emitting diode (LED) light modules that can be easily adapted to current light fixture products. LED technology offers more than twice the energy efficiency of traditional incandescent bulbs and has 20-30 times the reliability. A great deal of investment goes into the light fixture industrial design itself (e.g., housing, lens, etc.) and there is a great cost and time-to-market advantage in having modules that permit rapid conversion to LEDs.

Thus, a need exists for an LED lighting product having low power consumption and long life. Furthermore, a need exists for an LED lighting product to produce the same light output as a conventional incandescent bulb and have a similar form factor to the conventional lighting product to facilitate conversion.

SUMMARY

An LED lamp module designed to be easily retrofitted into existing incandescent based light fixtures with minimum modification is provided. The LED lamp module of the present disclosure permits lighting fixture manufacturers or end-user customers to realize the benefits of LED technology, e.g., more energy efficient and longer life than incandescent, while minimizing the impact to current light fixture designs.

The LED lamp module of the present discourse may be employed in place of a standard incandescent bulb via a plurality of connection means, e.g., hardwired or socket such as bi-pin, screw-in, etc. It is designed to accept the same power input and waveforms as the existing light fixtures (e.g. 10-30 VDC). The LED lamp module uses the host light fixture as a heat sink to transfer and dissipate heat to the external environment. Furthermore, the LED lamp module also works in conjunction with existing host fixture front lenses and reflectors with no or minimum modification.

According to one aspect of the present disclosure, an LED lamp module includes a generally circular metal core board including a first surface and a second surface; at least one LED disposed centrally on the first surface of the metal core board; and a flat annular printed circuit board including a current driver circuit for powering the at least one LED, the annular printed circuit board being disposed around the at least one LED and electrically coupled to the at least one LED, wherein the second surface of the metal core board is configured to contact a host fixture and heat generated by the at least one LED is conducted to the host fixture. The LED lamp module uses the host light fixture as a heat sink to transfer and dissipate heat to the external environment.

According to another embodiment, a lighting assembly is provided. The lighting assembly includes a host fixture including a generally cylindrical base configured to support a lighting module and a generally cylindrical cover including a parabolic reflector extending inside the cover from a first end of the cover to a second end of the cover, the reflector terminating in an annular rim; and the lighting module including a generally circular metal core board including a first surface and a second surface, the second surface being configured to contact the base of the host fixture, at least one LED disposed centrally on the first surface of the metal core board and a flat annular printed circuit board including a current driver circuit for powering the at least one LED, the annular printed circuit board being disposed around the at least one LED and electrically coupled to the at least one LED, wherein heat generated by the at least one LED is conducted to the host fixture.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Figure 1:
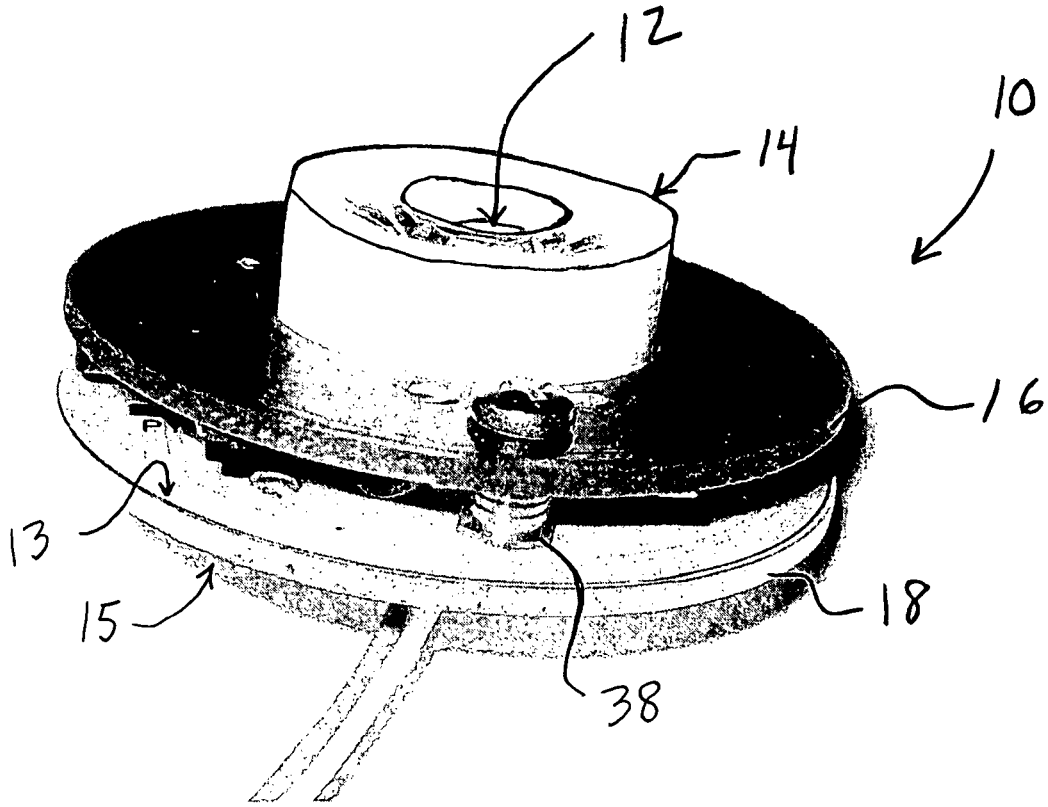
FIG. 1 is perspective view of a LED lamp module in accordance with an embodiment of the present disclosure.

Preferred embodiments of the present disclosure will be described hereinbelow with reference to the accompanying drawings. In the following description, well-known functions or constructions are not described in detail to avoid obscuring the invention in unnecessary detail. Throughout the drawings, like reference numerals represent like elements.

A light emitting diode (LED) lamp module 10 is provided as shown in FIG. 1. The LED lamp module 10 is composed of a metal core LED board 18 with an attached secondary optical element 14 and an electronics ("donut") board 16 that mechanically attaches to the LED board 18 with two screws/standoffs 38. The primary light source is a high power LED 12. An exemplary LED is a Luxeon III, three watt light emitting diode commercially available from Lumileds Lighting, U.S., LLC of San Jose, Calif.

Referring to FIG. 1, the compact LED lamp module 10 in accordance with the present disclosure employs a single LED device 12 to produce an amount of light comparable to a 10 Watt incandescent (e.g., Halogen) bulb. The LED lamp module 10 generates approximately 80 lumens of white light but also may be configured for red, green, blue and other color variations depending on the LED device employed. In one embodiment, the LED lamp module 10 uses a secondary optical element 14 to efficiently collimate that light emitting from the LED 12 to emit the light in the direction the light is intended to be used. When used in combination with a host fixture's existing reflector and front lens, the aesthetic appearance of the light emitted looks similar to the incandescent version.

Figure 2:
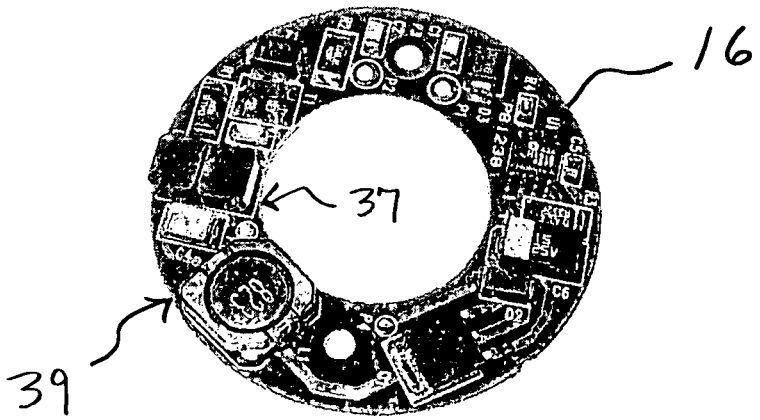
FIG. 2 is top view of an annular-shaped integrated electronics current driver board of the LED lamp module shown in FIG. 1.

Referring to FIG. 2, an integrated electronics current driver board 16 provides constant current to the LED device 12 over the full design input voltage range of 10-30VDC. The driver board 16 consumes less than 4 Watts of power to produce approximately the same amount of light output as the conventional 10Watt bulb that it replaces. The LED lamp module 10 is a direct replacement for the incandescent light assembly. The electronic driver design, shown in FIG. 2A, allows the LED light output to remain constant over the entire voltage range. The integrated electronics uses a switching regulator to efficiently convert (75% or greater) the input energy to the form required of the LED 12. The electronic driver design also provides transient protection (to guard against input power fluctuations) and EMI (electromagnetic interference) filtering to prevent interference with other electrical equipment in the vicinity of the light fixture. An optional dimming feature via dimming circuit 19 is provided so that the operator can adjust the light level as desired.

The electronics board 16 is designed in a "donut" or annular form factor to "piggyback" on top of the LED board 18 and around the host fixture's reflector, as will be described below in relation to FIGS. 6 and 7, to maximize compactness, space efficiency so that no, or minimal, mechanical changes are required to the host fixture. As can be seen in FIGS. 1 and 7, the electronics board 16 is substantially the same size as the LED board 18, i.e., have substantially the same size diameter and circumference.

Figure 2A:
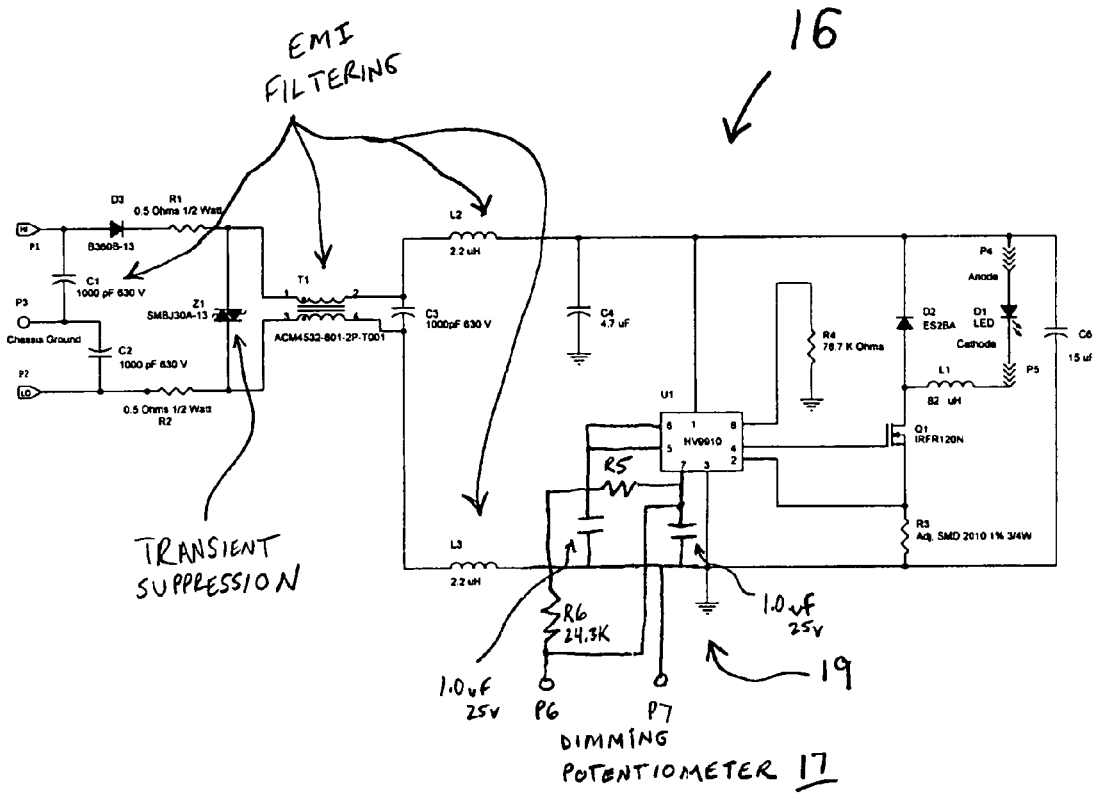
FIG. 2A is a schematic diagram of a current driver circuit in accordance with the present disclosure.

A schematic diagram of the current driver board is illustrated in FIG. 2A. The electronic board 16 employs a switching regulator approach (e.g., Supertex HV9910 as indicated in FIG. 2A as U1) to efficiently convert input power to that required of the LED 12, e.g., D1. The electronic design provides input power transient protection, e.g., via Z1, so that power fluctuations will not damage the circuit. A current driver design is used to provide constant current (typically 700 ma) to the LED, independent of the voltage (10-30VDC). EMI filtering components are provided (e.g., C1, C2, T1, L2 and L3 as indicated on FIG. 2A) to keep noise generated within the electronics board from traveling along the power leads P1 and P2, as shown in FIGS. 2 and 5, to the LED board 18.

The dimming feature is controlled by a potentiometer 17 either attached to, or remote from, the host light fixture and terminal to the dimming circuit 19 at terminals P6 and P7 as shown in FIG. 2A. The potentiometer 17 and dimming circuit 19 provides a variable analog voltage to an input on the switching regulator U1. The switching regulator U1 interprets this voltage level and reduces the current provided to the LED D1 accordingly to dim the light output.

The nature of the LED semiconductor device and the supporting electronics will provide a mean time between failure of greater than 50,000 hours, more than 25 times that of the incandescent bulb it replaces. To ensure long life, the LED junction temperature must be maintained below 125 degrees C. This is accomplished by mounting the LED 12 on a metal core printed circuit board (PCB) 18. The PCB 18 is directly mounted to the metal host light fixture to transfer the heat to the fixture and then to the ambient environment through radiation and convection methods. This technique eliminates the need for any other special heat sinking device.

Figure 3:
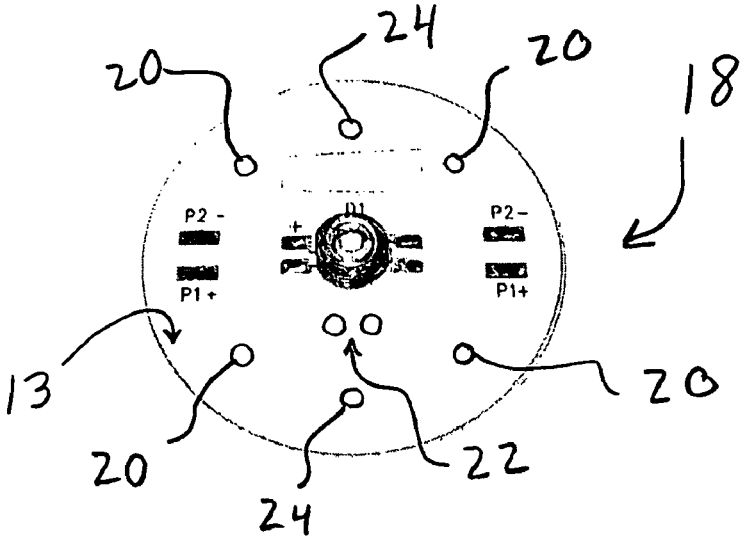
FIG. 3 is a top plan view of a LED board according to an embodiment of the present disclosure.
Figure 4:
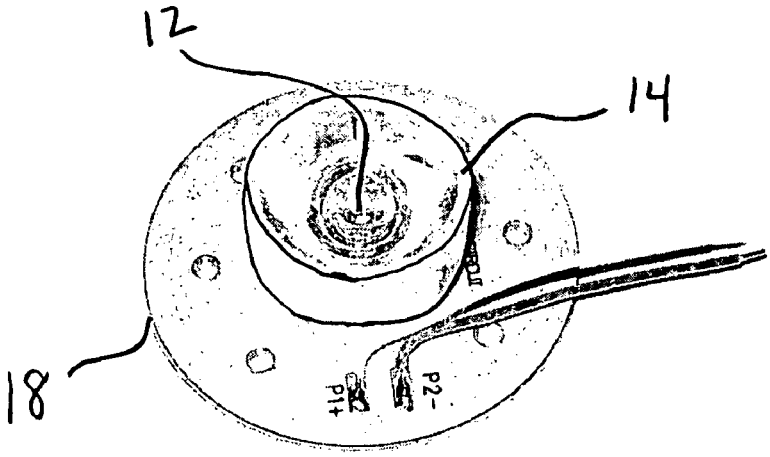
FIG. 4 is a top plan view of the LED board shown in FIG. 3 with an LED and optical element mounted thereon.
Figure 5:
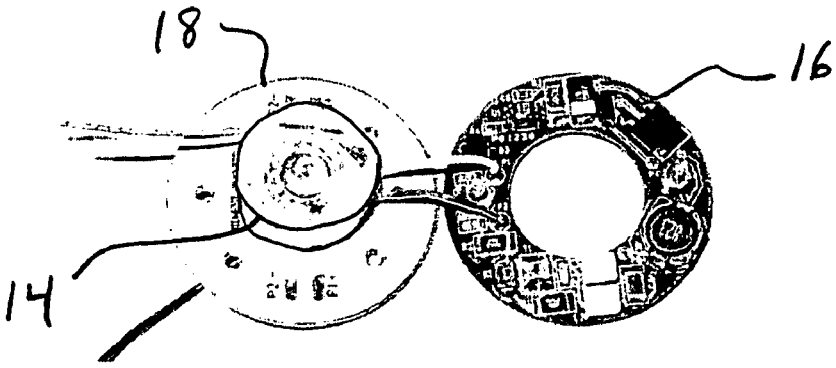
FIG. 5 is a top view of the current driver board coupled to the LED board.

Referring to FIGS. 3-5, the LED board 18 includes a first, top surface 13 and a second, bottom surface 15 and is circular in shape. Generally, the LED board is small in diameter and is configured to easily mount within an existing spotlight or reading light type fixture. As can be seen in FIGS. 1, 5 and 7, the LED board 18 is configured to be substantially the same size as the electronics board 16. The LED board 18 has four threaded holes 20 which are used to attach the LED lamp module 10 to the host fixture. There are two other holes 22 in the center of the LED board 18 to channel power leads through the base of the host fixture to the electronics board 16. Two additional threaded holes 24 are provided to mount the electronics boards 16. The LED board 18 has an aluminum backing 21, or coating on the second bottom surface, that mates with the host fixture 26 to transfer heat from the LED 12, as shown more clearly in FIG. 7.

The LED 12 is mounted to the first surface 13 of the LED board 18 and the secondary optical element 14 is placed (e.g., epoxied) over the LED 12. An exemplary optical element is an L2 Optics Series Lens commercially available from Lumidrives of Knaresborough, UK. This optical element efficiently captures (75% or greater) the light exiting the LED device 12 and directs it toward its intended target. The optical element 14 will create a spot with a total angle of 5, 10 or 25 degrees, depending on the properties of the lens selected. This optical system is designed to fit within the host system front reflector and lens with no, or minimal modification, as will be described in relation to FIGS. 6 and 7.

Figure 6:
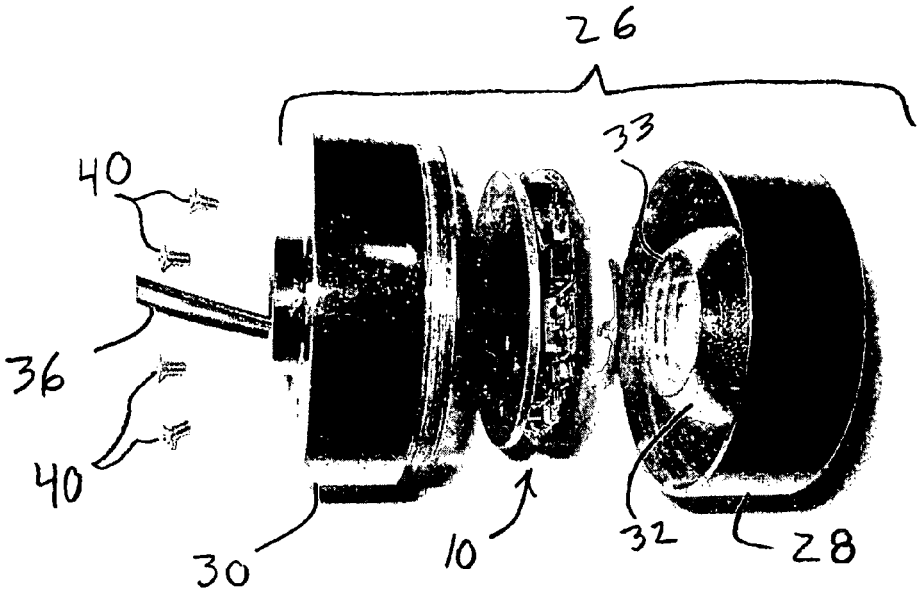
FIG. 6 is an exploded view of the LED lamp module employed with a conventional lighting fixture housing.
Figure 7:
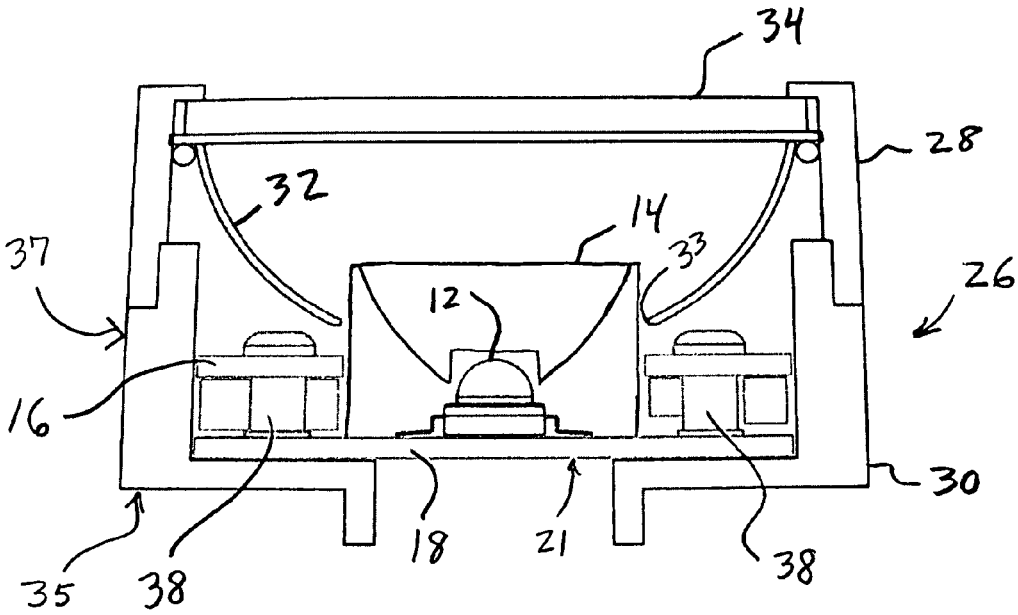
FIG. 7 is a cross sectional view of the LED lamp module mounted in the housing of FIG. 6.
Figure 8:
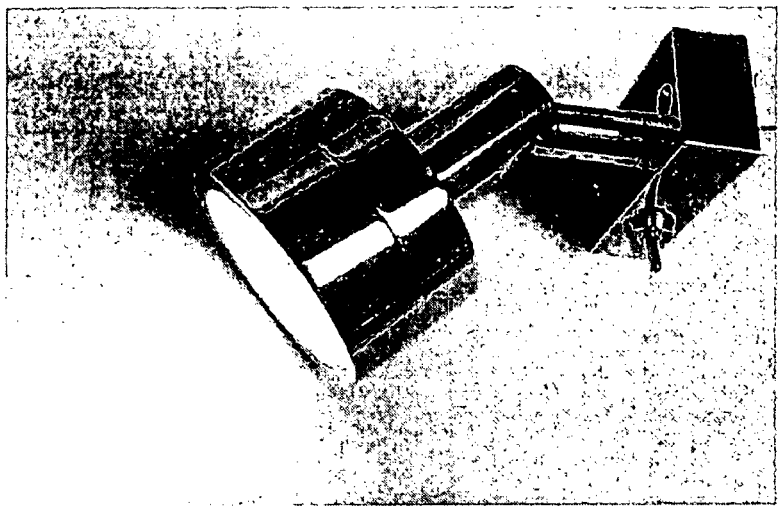
FIG. 8 is a perspective view of a lighting fixture employing the LED light module of the present disclosure.

Referring to FIGS. 6 and 7, a host lighting fixture 26 for supporting the LED lamp module 10 is illustrated. The fixture 26 will include a generally cylindrical cover 28 and generally cylindrical base 30 which are mated together, in one embodiment, with a screw-type connection. The base will include a bottom portion 35 and surrounding side wall 37 to support the LED lamp module 10. The cover 28 will include a parabolic reflector 32 extending inside the cover from a first end of the cover to a second end of the cover. The reflector 32 will terminate in an annular rim 33. Furthermore, the cover 28 will include a front window lens 34. The front window lens 34 may be clear plastic or glass, but will optionally have a diffusing surface or prismatic lens structure to diffuse the light, widen the pattern and contribute to the aesthetic look of the front of the fixture 26. Light emanating from the optical element 14 will then pass through the front lens 34. Some light will also reflect back from the front lens, back to the reflector 32, before being transmitted back out the front lens. This effect provides the aesthetic affect of broadening the perceived light pattern width when looking into the light fixture as illustrated in FIG. 8.

The electronics board 16 is "donut" or annular shaped having an inner circumference 37 and outer circumference 39. The annular board 16 is configured to mount on top of the LED board 18 and around the optical element 14, while also allowing clearance for the reflector 32 of the host fixture 26 (see FIG. 7). As can be seen in FIGS. 6 and 7, the electronics board 16 and 18 are of substantially the same size. Furthermore, the inner circumference 37 of the electronics board 16 is greater than an outer circumference of the optical element 14 allowing the optical element 14 to pass therethrough. In other embodiments, the optical element 14 is not employed and the reflector is configured to extend down closer to the LED 12. The rim of the reflector will extend into the inner circumference of the electronics board 16 and come into close proximity of the LED 12.

The electronics board 18 is mounted to the LED board 16 by standoffs 38 which prevent the circuitry of the electronics board 16 from coming into contact with the LED board 18. The standoffs 38 are made form an electrically conductive and thermally conductive material. Heat generated by the circuitry of the electronics board will be conducted via the standoffs 38 to the LED board 18 and subsequently to the host fixture. The overall electronics design is very compact to fit within the available space, having no additional impact on the host fixture.

The electronics board 16 is grounded to the host light fixture housing 26 via screws and/or standoffs 38 that mates the electronics board 16 to the LED board 18, and then, the LED board 18 is grounded to the host light fixture 26 by mounting screws 40. It is to be appreciated that the screws and/or standoffs are made from an electrically conductive material. This design allows the host fixture metallic housing 26 to act as a Faraday shield for suppression of radiated EMI. The LED board 18 and electronics board 16 are electrically connected as shown in FIG. 5 to drive the LED 12. Two additional wires 36 bring power from the base 30 of the host fixture to the electronics board.

Figure 9:
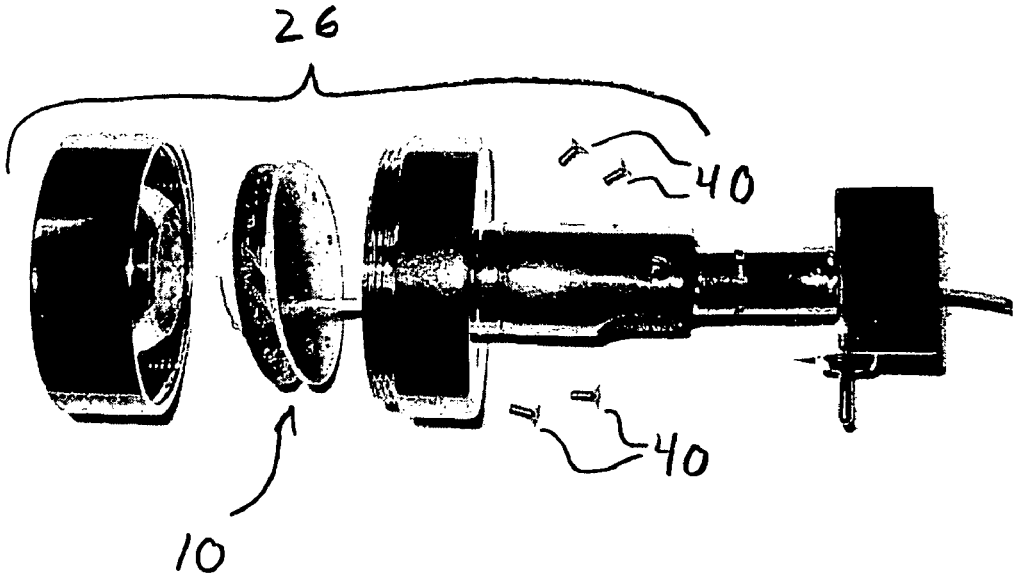
FIG. 9 is an exploded view of the lighting fixture shown in FIG. 8.

The fully assembled LED lamp module 10 is connected to the host light fixture 26 using four screws 40 as show in FIG. 9.

The design of the LED lamp module 10 of the present disclosure facilities heat dissipation away from the LED 12 which ensures long life of the LED. This is done by mounting the LED 12 on the metal backed printed circuit board (PBC) 18 which conducts the heat generated by the LED 12 away from the LED 12, through the metal backed PCB 18 to the host light fixture 26. The second surface 15 of the LED board 18 is configured to being in substantial contact with the bottom portion 35 of the host fixture's base 30 to allow heat generated by the LED 12 to be conducted through the backing 21 of the LED board 18 to the host fixture 26. The metal backed PCB 18 is also the mounting mechanism to the host fixture that is secured with 4 screws along with a layer of thermally conductive material to improve the heat transfer from the metal backed PCB 18 to the host fixture 26. This thermal management system then transfers the heat from the host fixture to the ambient environment through primarily convection. By keep the junction temperature of the LED below its design maximum value, its long service life is ensured.

While the disclosure has been shown and described with reference to certain preferred embodiments thereof, it will be understood by those skilled in the art that various changes in form and detail may be made therein without departing from the spirit and scope of the disclosure.

What is claimed is:

1. A light emitting diode (LED) lamp module comprising:

a generally circular metal core printed circuit board including a first surface and a second surface;

at least one LED disposed centrally on the first surface of the metal core printed circuit board; and a flat annular printed circuit board including a current driver circuit for powering the at least one LED, the current driver circuit disposed along a first surface of the annular printed circuit board, the annular printed circuit board being disposed around the at least one LED and electrically coupled to the at least one LED, the first surface of the annular printed circuit board being in a face to face relationship with the first surface of the metal core printed circuit board, wherein the second surface of the metal core printed circuit board is directly mounted in a face to face relationship with a host fixture and heat generated by the at least one LED is conducted to the host fixture via the metal core printed circuit board wherein the metal core printed circuit board is spaced apart from the annular printed circuit board by at least one electrically conductive and thermally conductive standoff, wherein the at least one electrically conductive and thermally conductive standoff electrically grounds the annular printed circuit board to the metal core printed circuit board and conducts heat generated by the annular printed circuit board to the metal core printed circuit board.

2. The LED lamp module of claim 1, wherein the second surface of the metal core board includes an aluminum backing.

3. The LED lamp module of claim 1, further comprising an optical element disposed over the at least one LED to collimate light emitting from the at least one LED wherein the optical element mates to the first surface of the metal core board.

4. The LED lamp module of claim 1, wherein the annular printed circuit board includes an inner circumference and an outer circumference, further comprising an optical element disposed over the at least one LED to collimate light emitting from the at least one LED, wherein the optical element has an outer circumference less than the inner circumference of the annular printed circuit board.

5. The LED lamp module of claim 1, wherein an outer circumference of the metal core board is substantially the same size as an outer circumference of the annular printed circuit board.

6. The LED lamp module of claim 5, wherein the metal core board is spaced apart from the annular printed circuit board by at least one standoff, wherein the outer circumference of the metal core board aligns with outer circumference of the annular printed circuit board.

7. The LED lamp module of claim 6, wherein the at least one standoff is made from electrically conducting material and electrically grounds the annular printed circuit board to the metal core board.

8. The LED lamp module of claim 1, wherein the current driver circuit includes a switching regulator for converting input voltage to constant current for powering the at least one LED.

9. The LED lamp module of claim 8, wherein the current driver circuit further includes a dimming circuit configured to provide a variable analog voltage to the switching regulator, wherein the switching regulator reduces the current to the at least one LED reducing the light output.

10. A lighting assembly comprising a metallic host fixture comprising:

a generally cylindrical base configured to support a lighting module, the base including a flat bottom portion and a surrounding side wall; and a generally cylindrical cover configured to be coupled to the base including a parabolic reflector extending inside the cover from a first end of the cover to a second end of the cover, the reflector terminating in an annular rim; and the lighting module comprising:

a generally circular, flat metal core printed circuit board including a first surface and a second surface, the second surface being directly mounted in a face to face relationship to the flat bottom portion of the base of the metallic host fixture;

at least one LED disposed centrally on the first surface of the metal core printed circuit board; and a flat annular printed circuit board including a current driver circuit for powering the at least one LED disposed along a first surface of the annular printed circuit board, the annular printed circuit board being disposed around the at least one LED and electrically coupled to the at least one LED, the first surface of the annular printed circuit board being in a face to face relationship with the first surface of the metal core printed circuit board wherein the metal core printed circuit board is grounded to the base of the metallic host fixture and is spaced apart from the annular printed circuit board by at least one electrically conductive and thermally conductive standoff, wherein the at least one electrically conductive and thermally conductive standoff electrically grounds the annular printed circuit board to the metal core printed circuit board thereby grounding the annular printed circuit board to the metallic host fixture and conducts heat generated by the annular printed circuit board to the metal core printed circuit board which is subsequently conducted to the host fixture, wherein heat generated by the at least one LED is conducted to the metallic host fixture via the metal core printed circuit board.

11. The lighting assembly of claim 10, wherein the second surface of the metal core board includes an aluminum backing.

12. The lighting assembly of claim 10, further comprising an optical element disposed over the at least one LED to collimate light emitting from the at least one LED, wherein the optical element is configured to extend through the annular rim of the reflector.

13. The lighting assembly of claim 10, wherein the metallic host fixture acts as a Faraday shield for suppression of radiated electromagnetic interference (EMI).

14. The lighting assembly of claim 10, wherein an outer circumference of the metal core board is substantially the same size as an outer circumference of the annular printed circuit board.

15. The lighting assembly of claim 14, wherein the metal core board is spaced apart from the annular printed circuit board by at least one standoff, wherein the outer circumference of the metal core board aligns with outer circumference of the annular printed circuit board.

16. The lighting assembly of claim 15, wherein the at least one standoff is made from electrically conducting material and electrically grounds the annular printed circuit board the metal core board.

* * * * *